United States Patent [19]

Narasaka et al.

[11] Patent Number: 4,526,148

[45] Date of Patent: Jul. 2, 1985

[54] AIR-FUEL RATIO CONTROL SYSTEM FOR AN INTERNAL COMBUSTION ENGINE

[75] Inventors: Shin Narasaka, Yono; Kazuo Otsuka, Higashi-Kurume; Eiji Kishida, Tokyo, all of Japan

[73] Assignee: Honda Giken Kogyo Kabushiki Kaisha, Tokyo, Japan

[21] Appl. No.: 471,269

[22] Filed: Mar. 2, 1983

[30] Foreign Application Priority Data

Mar. 31, 1982 [JP] Japan ..... 57-053161

[51] Int. Cl.[3] ..... F02M 7/12

[52] U.S. Cl. ..... 123/440; 123/494

[58] Field of Search ..... 123/440, 489, 478, 494

[56] References Cited

U.S. PATENT DOCUMENTS 4,271,797 6/1981 McCarbery ..... 123/412

4,280,465 7/1981 Staerzl ..... 123/494

*Primary Examiner*—Tony M. Argenbright

*Attorney, Agent, or Firm*—Armstrong, Nikaido, Marmelstein & Kubovcik

[57] ABSTRACT

A closed-loop air-fuel control system for an internal combustion engine comprising a control circuit having an open-loop mode of operation in which an air-fuel ratio control signal is fixed to a predetermined value determined by a sensed value of the atmospheric pressure and the temperature of the intake air of the engine. In order to shorten the time period for calculating the air-fuel ratio and to simplifying the circuit construction, an output signal of an atmospheric pressure sensor is supplied to an intake air temperature sensor so as to produce an output signal which represents both the temperature of the intake air and the atmospheric pressure at the same time.

3 Claims, 3 Drawing Figures

AIR-FUEL RATIO CONTROL SYSTEM FOR AN INTERNAL COMBUSTION ENGINE

BACKGROUND OF THE INVENTION

1. Field of the Invention

The present invention relates to an air-fuel ratio control system for an internal combustion engine, and more specifically to a so called microprocessor operated closed-loop control system in which the air-fuel ratio is adjusted in relation to the concentration of oxygen measured by a sensor in an exhaust system of the engine.

2. Description of the Prior Art

In an internal combustion engine provided with a catalytic converter to improve the emission characteristics, a closed-loop air-fuel ratio control system is generally utilized to produce an air-fuel mixture of a theoretical value (14.7:1) which allows the catalytic converter to work most efficiently.

Such a closed-loop air-fuel ratio control system comprises an oxygen sensor which is provided, in an exhaust system of the engine, upstream of the catalytic converter to produce an electric signal indicative of the oxygen concentration. The output signal of the oxygen sensor is then applied to a control circuit which produces a fuel supply control signal in accordance with the oxygen sensor output signal and other parameters which are measured by various sensors such as a throttle position sensor. The fuel supply control signal is applied to a fuel supply means such as a carburetor with an air-fuel ratio adjusting device. The air-fuel ratio of the mixture supplied to the engine is thus maintained at the theoretical value by the closed-loop control system.

The closed-loop control system, however, is designed to be capable of rapidly switching from its closed-loop mode of operation in which the air-fuel ratio is controlled to predetermined values other than the theoretical value, that is, independently of the exhaust emissions for meeting with the demands of good drivability and stability of the engine. For example, the closed-loop control system operates in an open-loop mode during start-up and cold operation of the engine and momentarily during acceleration and deceleration.

However, during the open-loop operation of the system, which is effected by fixing a needle valve for controlling the aperture of an air bleed in the carburetor for example, the air-fuel ratio tends to vary with the changes in atmospheric pressure and intake air temperature. In order to prevent such an adverse effect, the control circuit is generally provided with signals from an atmospheric pressure sensor and an intake air temperature sensor for producing an fuel supply control signal which is adjusted by the output signals form these sensors to compensate for the variation of the air-fuel ratio.

In prior art air-fuel ratio control systems operated by a microprocessor, however, the provision of the correction function, in other words, the provision of atmospheric pressure signal and the intake air temperature signal has required seperate programs for respectively processing the atmospheric pressure signal and the intake air temperature signal. Furthermore, such a provision has resulted in a slow down of the speed of processing in the microproccessor unit which might serve as the other engine control means at the same time. This condition has resulted in a deterioration of the preciseness of the air-fuel ratio control.

SUMMARY OF THE INVENTION

An object of the present invention is therefore to eliminate the drawback of the prior art air-fuel ratio control system and to provide a microprocessor operated closed-loop air-fuel ratio control system in which the high speed of the calculation of fuel supply is achieved by simplifying the calculation process.

Another object of the present invention is to provide a microprocessor operated closed-loop control system having precise air-fuel ratio control characteristics.

According to the present invention, a closed-loop air-fuel ratio control system for an internal combustion engine having an exhaust system comprises an oxygen sensor disposed in the exhaust system, an air pressure sensor means for sensing an atmospheric pressure and producing an air pressure signal having a voltage level responsive to the atmospheric pressure, and an intake air temperature sensor means for sensing the temperature of an intake air and producing a temperature signal having a voltage level responsive to the temperature of the intake air. The air pressure signal and the temperature signal are superposed on each other to produce a combined sensor signal. A control means for producing a fuel supply control signal has a closed-loop mode of operation in which the fuel supply control signal is calculated on the basis of an output signal of the oxygen sensor and an open-loop mode of operation in which the fuel supply control signal is fixed to a predetermined value which is determined in accordance with the combined sensor signal upon occurence of a predetermined operational state of the engine. A fuel supply control means controls the fuel supply in response to the fuel supply control signal. In operation, the output signal of one of the air pressure sensor means and the intake air temperature sensor means is applied to the other.

The forgoing and other objects and advantages of the present invention will become more clearly understood upon review of the following description taken in conjunction with the accompanying drawings.

DETAILED DESCRIPTION OF A PREFERRED EMBODIMENT

Figure 1:
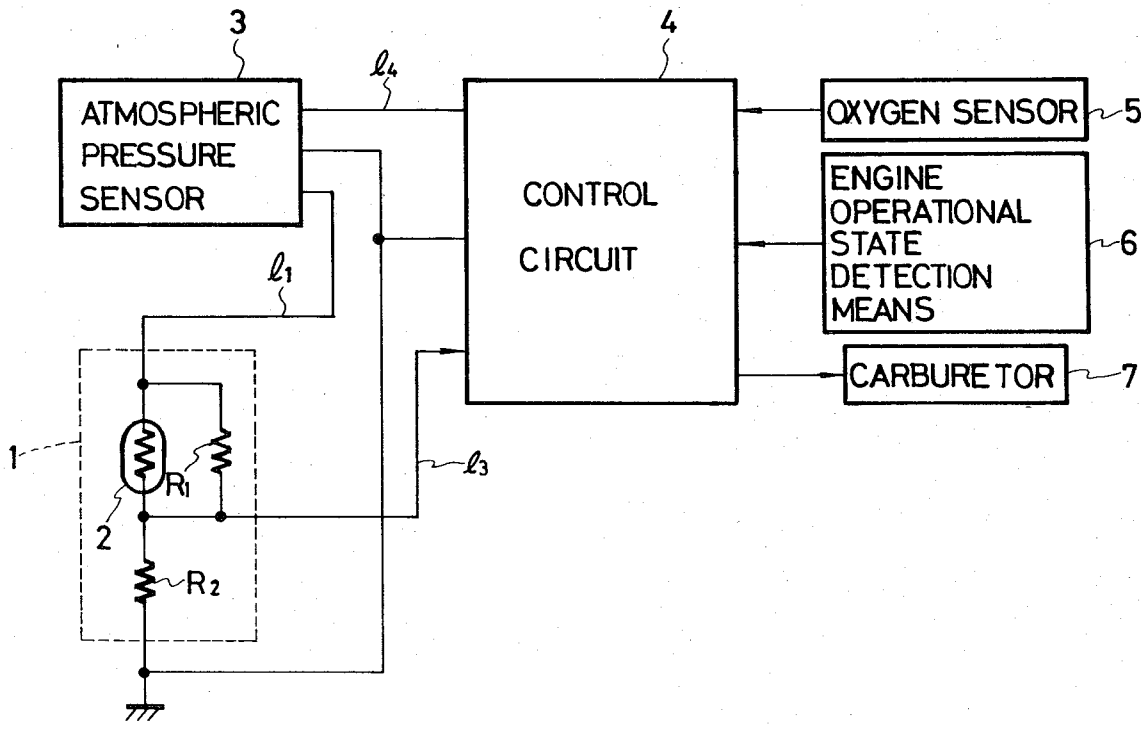
FIG. 1 is a block diagram of an embodiment of the air-fuel ratio control system according to the present invention.

Reference is first made to FIG. 1 in which an embodiment of the closed-loop air-fuel ratio control system according to the present invention is depicted.

The system comprises an intake air temperature sensor 1 which includes a thermistor 2 disposed in an intake air passage of an internal combustion engine (not shown), a resistor $R_1$ connected in parallel to the thermistor 2, and a resistor $R_2$ connected in series therewith. The resistance of the thermistor 2 varies with the temperature of the intake air and in combination with the resistors $R_1$ and $R_2$ forms a voltage divider circuit.

An output voltage of an atmospheric pressure sensor 3 which may be semiconductor pressure sensor for converting the variation of the stress applied thereto into an electrical resistance, is supplied to the intake air temperature sensor via a line $l_1$. An output signal of the intake air temperature sensor 1, i.e., the voltage developed across the terminals of the resistor $R_2$ is applied to a control circuit 4 including a microprocessor unit therein via line $l_3$. A line $l_4$ is used for supplying a power voltage to the atmospheric pressure sensor 3 from the control circuit 4.

The semiconductor pressure sensor may be used as the atmospheric pressure sensor 3 which comprises a silicon diaphragm having a gauge portion diffused at a predetermined position, and has an electric resistance value which varied with the variation of the magnitude of the stress due to the atmospheric pressure applied to the silicon diaphragm in accordance with the piezoelectric effect. Since the semiconductor pressure sensor described above can produce only slight change in the resistance thereof against the variation of the atmospheric pressure, the atmospheric pressure sensor 3 generally incorporates therein an amplifier for amplifying the output signal of the semiconductor pressure sensor. Therefore, the power voltage from the control circuit 4 which is generally regulated to have a constant voltage level is supplied to the amplifier in the atmospheric pressure sensor, which is able to operate properly only when a power voltage of a predetermined suitable range is applied thereto.

The control circuit 4 further receives an output signal of an oxygen sensor 5 which is disposed in the exhaust system of the engine, and an output detecion signal of a means 6 for detecting a specific operational state of the engine which includes various sensors such as an engine rotational speed sensor and an intake manifold pressure sensor whereby the control circuit 4 performs either one of the closed-loop mode of operation or the open-loop mode of operation, in accordance with the detection signal from the means 6. A fuel supply control signal calculated by the control circuit 4 is applied to a carburetor 7 having an air-fuel ratio adjustment device (not shown).

The operation of the system will be explained hereafter with reference to FIGS. 2 and 3.

Figure 2:
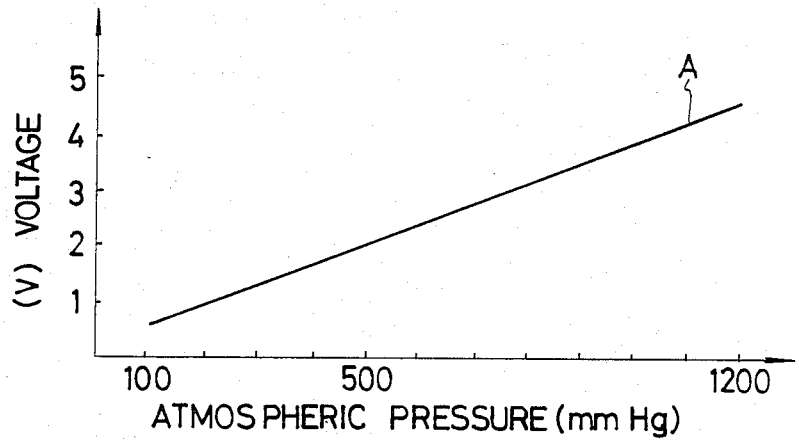
FIG. 2 is a graph illustrating the relationship between the output voltage of an atmospheric pressure sensor and the actual atmospheric pressure.
Figure 3:
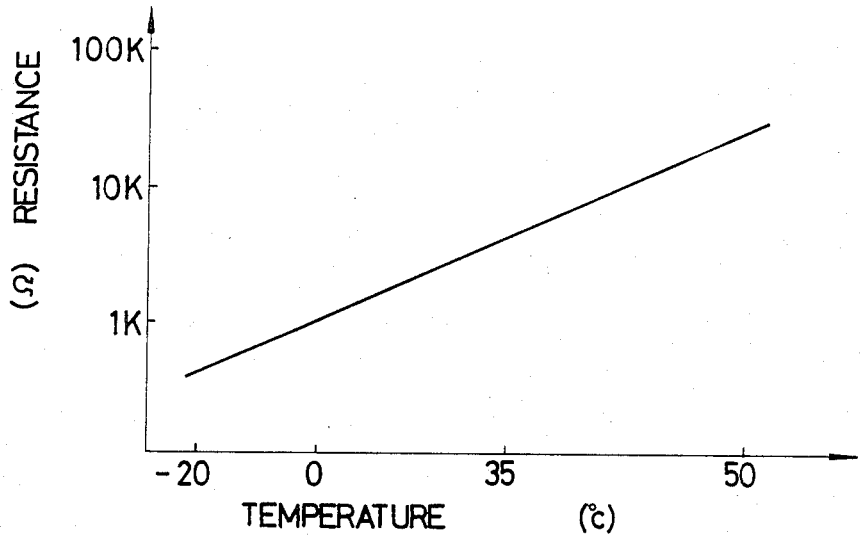
FIG. 3 is a graph illustrating the resistance-temperature characteristics of a thermistor used as intake air temperature sensing means.

As shown in FIG. 2, the output voltage level of the atmospheric pressure sensor 3 increases with an increase in the atmospheric pressure. Turning to FIG. 3, the resistance value of the thermistor 2 increases with an increase in the intake air temperature. Therefore, the output voltage level of the intake air temperature sensor 1 decreases with the increase in the intake air temperature, and also increases with the increase in the atmospheric pressure. In other words, the output signals of the temperature sensor 2 and the air pressure sensor 3 are superposed on each other to produce a combined sensor signal which represents the changes in the temperature of intake air and in the atmospheric pressure at the same time.

The output voltage characteristics of the intake air temperature sensor 1 described above is adapted based on the fact that the air-fuel ratio of the mixture tends to shift to the lean side when the atmospheric pressure is high, and to the rich side when the temperature of intake air is high. Accordingly, it is necessary to compensate for the air-fuel ratio control in a manner that a target value of the air-ruel ratio control is shifted to the rich side when the atmospheric pressure increases or when the intake air temperature decreases, i.e. when the output voltage level of the intake air temperature sensor increases 1, that is the combined sensor signal.

In order to realize the compensation function discribed above, the control circuit 4 compares the output signal of the intake air temperature with a predetermined reference level. When the output level of the intake air temperature sensor 1 is equal to the reference level, in other words when the density of the intake air is equal to a predetermined density value, the air-fuel ratio control signal is maintained and no correction is effected. When the output level of the intake air temperature sensor 1 is higher than the reference level, the air-fuel ratio control signal is corrected to the rich side. Furthermore, the control circuit 4 is so arranged that the magnitude of the correction value is proportional to the difference between the output level of the intake air temperature sensor and the reference level.

It will be understood from the foregoing that according to the present invention, the construction of the control circuit for producing the air-fuel ratio control signal is simplified by using the combined sensor signal which represents both of the intake air temperature and the atmospheric pressure. The circuit arrangement of the control system according to the present invention has a further advantage in that the speed of the execution of the program in the microprocessor of the control circuit is shortened since the steps for processing the output signal of the atmospheric pressure sensor is eliminated. In addition, precision of the air-fuel ratio control is greatly improved by the thus shortened period of each calculation cycle.

Above, a preferred embodiment of the present invention has been described. It is to be noted, however, that the foregoing descriptions are for illustrative purpose only, and number of modifications are possible to those skilled in the art, and the scope of the present invention is not limited by only appended claims. As an example, a negative temperature coefficient (NTC) thermistor may be used in place of the positive temperature coefficient (PTC) thermistor which is used in the preferred embodiment. In that case, the thermistor should be connected in parallel to the resistor $R_2$.

What is claimed is:

1. A closed-loop air-fuel ratio control system for an internal combustion engine having an exhaust system comprising:

an oxygen sensor disposed in said exhaust system;

an air pressure sensor means for sensing an atmospheric pressure and for producing a pressure signal having a voltage level responsive to said atmospheric pressure;

an intake air temperature sensor means for sensing the temperature of the intake air of said engine and for producing a temperature signal having a voltage level responsive to said temperature of intake air, said air pressure sensor means being connected to said intake air temperature sensor means so that said pressure signal is applied to said temperature sensor means as an input voltage and that said temperature signal from said temperature sensor means becomes a combined sensor signal whose level has a component of the level of said pressure signal;

a control circuit means for producing a fuel supply control signal, an output signal of said oxygen sensor and said combined sensor signal responsive to the atmospheric pressure and the temperature of the intake air are respectively supplied as an input signal to said control circuit means, said control circuit means having a closed-loop mode of operation in which said fuel supply control signal is calculated on the basis of an output signal of said oxygen sensor and an open-loop mode of operation in which said fuel supply control signal is fixed to a predetermined value which is determined in accordance with said combined sensor signal upon occurrence of predetermined operational states of the engine; and a fuel supply control means coupled to said control circuit means, for controlling the fuel supply in response to said fuel supply control signal.

2. A system as set forth in claim 1, wherein said intake air temperature sensor means comprises a thermistor having an electric resistance which varies with the temperature of the intake air, and a resistor connected in series therewith, and wherein said temperature signal is produced at the junction between said thermistor and said series resistor.

3. A system as set forth in claim 2, wherein the output of said atmospheric pressure sensor is coupled to the terminal of said thermistor which is not the junction between said thermistor and said series resistor.

* * * * *